US005129703A

United States Patent [19]

Ballendat et al.

[11] Patent Number: 5,129,703

[45] Date of Patent: Jul. 14, 1992

[54] CHAIR STRUCTURE FOR THE ASSEMBLAGE OF CHAIR ROWS

[75] Inventors: Martin Ballendat, Simbach/Inn, Fed. Rep. of Germany; Georg Reinthaler, Altheim, Austria

[73] Assignee: Wiesner-Hager KG, Altheim, Austria

[21] Appl. No.: 634,231

[22] Filed: Dec. 27, 1990

[30] Foreign Application Priority Data

Dec. 29, 1989 [DE] Fed. Rep. of Germany ..... 3943312

[51] Int. Cl.[5] ..... A47C 15/00

[52] U.S. Cl. ..... 297/248; 297/421; 248/188

[58] Field of Search ..... 297/248, 444, 440, 421; 403/353, 384, 444; 248/188, 222.3, 225.1, 220.2

[56] References Cited

U.S. PATENT DOCUMENTS

| | | | |
|---|---|---|---|
| 1,520,520 | 12/1924 | Thomason | 403/353 X |
| 2,554,675 | 5/1951 | Magnetti | 248/225.1 X |
| 3,328,075 | 6/1967 | Albinson | 297/248 X |
| 3,635,521 | 1/1972 | Shivvers | 297/248 X |
| 4,657,302 | 4/1987 | Snyder | 297/440 X |

FOREIGN PATENT DOCUMENTS

| | | | |
|---|---|---|---|
| 772012 | 5/1971 | Belgium . | |
| 1851321 | 5/1962 | Fed. Rep. of Germany . | |
| 2218289 | 10/1973 | Fed. Rep. of Germany . | |
| 8028978 | 10/1980 | Fed. Rep. of Germany . | |
| 1079556 | 8/1967 | United Kingdom . | |
| 1279618 | 6/1972 | United Kingdom | 297/248 |

*Primary Examiner*—Kenneth J. Dorner
*Assistant Examiner*—J. Bonifanti
*Attorney, Agent, or Firm*—Fleit, Jacobson, Cohn, Price, Holman & Stern

[57] ABSTRACT

The expense required for the assemblage of chair rows consisting of individual chairs is considerably reduced in that legless intermediate members are inserted between chairs with legs, specifically legless seat shells or legless trays. Versatility is additionally increased by means of serial connectors which permit the identical fastening members to be covered or to be directly connected.

8 Claims, 3 Drawing Sheets

CHAIR STRUCTURE FOR THE ASSEMBLAGE OF CHAIR ROWS

The invention relates to a chair structure for the assemblage of seat rows of stackable, interlinked chairs, where the external side boundary of a seat is formed by two screw heads positioned at a given distance one behind the other, each of which screw heads have a groove about the periphery adapted to engage the snap-in openings of insert locks on the adjacent seat.

A seat of this type is known to the prior art (DE-GM 18 51 321) in which the stacking capability is assured such that the two seat legs of one seat side have a U-shape pointing to the floor, with legs that open outward. In order to permit these stackable seats to be into seat rows, screw heads groove about its periphery are allowed to project on the one side, above the external border of the seats, while on the other side the projecting screw heads are recessed in such a way as to form the snap-in openings for the grooves. Two such screw heads are positioned on either side and at the same height, at a distance one behind the other. Installation here occurs in such a way that a chair in tipped positioned is placed with one of its snap-in openings onto one of the screw heads; by pressing down the tipped chair into horizontal position, the other snap-in openings will also be pushed onto their assigned screw heads. It is evident that each chair can be only connected with one adjacent chair. Consequently, the number of necessary tipping actions is the same as the number of the chairs to be connected. Furthermore, all chairs must have a completely identical design. Finally, the specially designed screw heads differ from one side of the chair to the other and must be secured in each case with a counternut beneath the seat. This makes production expensive.

Also known to the prior are stackable chairs that can be connected to form rows (DE 36 13 381 C2), in which the seat panel and the back cushion are designed as a single-part elastic shell that simultaneously forms the support structure, which can be inclined flexibly around a crossbeam resting beneath the front edge of the seat panel. Chairs of this type have good seat characteristics. Within limits, they are also stackable, but can only be arranged in rows with considerable effort.

The goal of the present invention is to significantly reduce the total costs for the assemblage of rows of chairs by means of a new design, while simultaneously increasing the chair's versatility. The goal is forwarded by the invention, as described in the claims.

It will be recognized that every second chair is without legs. It thus consists only of the seat, which is inserted on either side between the adjacent chairs. It is apparent that the total expense in terms of material and the costs for producing chair rows of a prescribed number of seats can be significantly reduced, namely by about 30%. Manipulation is also accelerated, in that a legless seat shell of this type can be simultaneously connected to two adjacent chairs that do have legs. Finally, the versatility of the system is increased, since the legless seat shell can be replaced by a tray or the like, which was not possible with previous chair designs for the construction of chair rows.

Since it must be possible to connect the chairs among themselves, the chairs under the invention are provided on both sides with identically projecting circular groove screw heads. Further, the invention provides a special free single part, specifically a serial connector, which displays snap-in openings on either side. On one side, one of the snap-in openings is open from behind, while the other snap-in opening is open from below. As an alternative, the front snap-in opening can be open from the front and the back snap-in opening can be open from below. The serial connector can thereby be mounted easily onto one of the circular groove screw heads by means of the horizontally open snap-in openings; by rotation around of the axis thus created it can be engaged with the second circular groove screw head on the same chair by means of its other snap-in opening.

On the other side the same serial connector displays two adjacent snap-in openings open from below. These permit the chair provided with a serial connector to be easily pressed onto the circular groove screw heads of the adjacent chair, without the serial connector disconnecting itself. The serial connector thus securely binds the adjacent chairs, now arranged in series, even when a legless seat shell is not inserted between the adjacent chairs. The serial connector also covers the projecting peripherally grooved screw heads and can thus also be used for the ends of chair rows in order to provide them with a pleasing appearance. If this is not important, then the parallel snap-in openings of the serial connector can naturally be open from the top instead of from the bottom.

It is also particularly effective when the circular groove screw heads are not designed as special parts furnished for this purpose, but rather when the screw heads of the fastening screws screwed into the crossbeam beneath the seat shell are employed for this purpose. Since for reasons of function the groove screw heads should be circular in shape, they can advantageously take the form of hexagon socket screws.

BRIEF DESCRIPTION OF THE DRAWINGS

The diagram, to which reference is expressly made for all individual features not explained below, elucidates the invention on the basis of examples. Shown are.

DETAILED DESCRIPTION OF DRAWINGS

Figure 1:
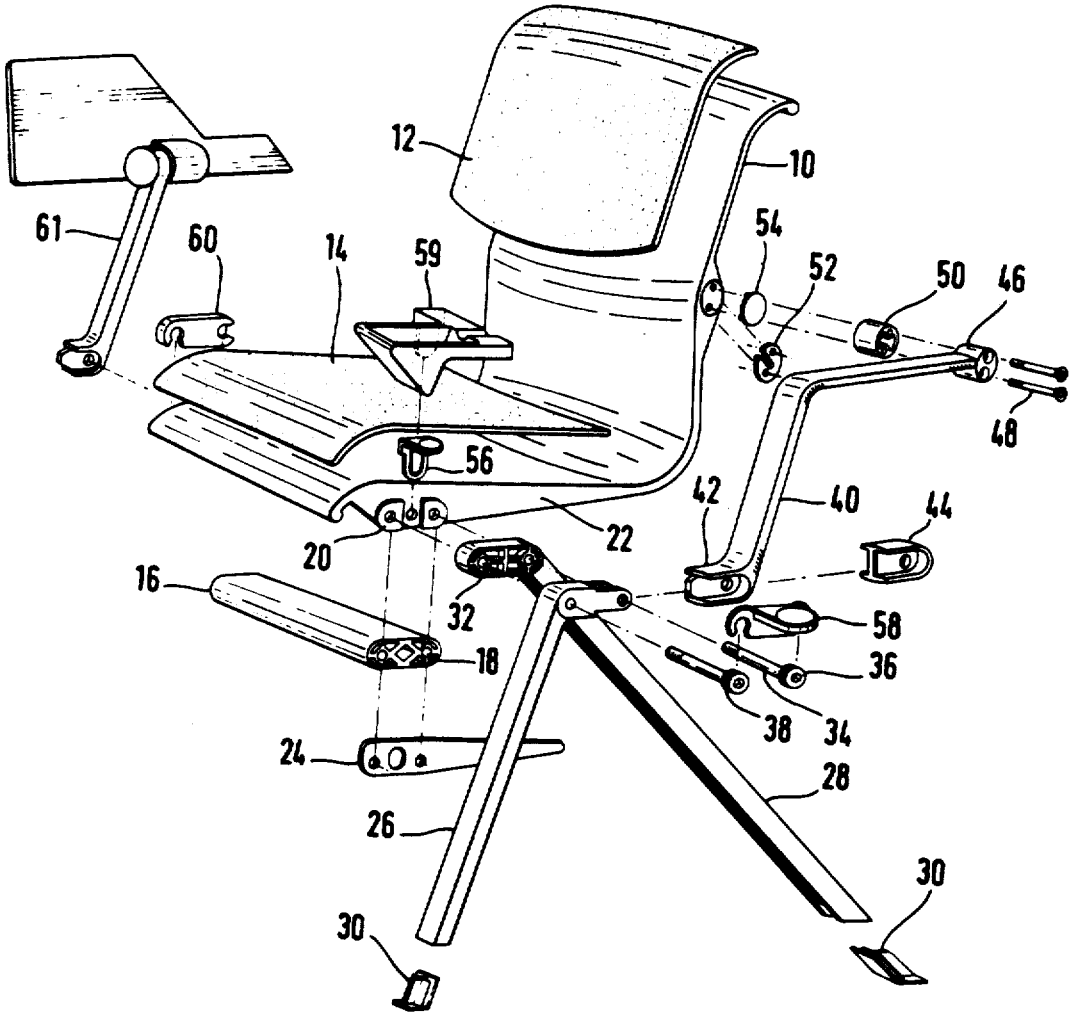
FIG. 1 an exploded view of an embodiment of the inventive chair with legs.

FIG. 1 shows an embodiment of the chair structure, with a single-piece seat shell 10 molded anatomically in a manner known to the prior art. As based on its shape and material the seat shell 10 displays the necessary elastic characteristics. To increase comfort the seat shell can be covered with a back cushion 12 and a seat cushion 14, or with a continuous cushion. Beneath the seat panel of the seat shell 10 and in the area where the back of a seated person's knee would be, i.e. slightly displaced from the front edge in the direction of the backrest, there is a stable crossbeam 16 of aluminum. The shape of the crossbeam 16 is that of a flat, horizontal beam which is closed at is front and back end by a semicircle. In the center of the semicircle there is a throughhole 18. If the crossbeam 16 is mounted beneath the seat shell 10, the throughholes 18 rests in succession horizontally and at the same height.

As can be seen in FIG. 1, in the area of the throughholes 18 the seat shell 2 has flanges 22 which are directed downward and which are reinforced with aluminum reinforcements 20; the crossbeam 16 is inserted between these flanges 22. In addition, a bracing in the form of a club-shaped seat support 24 is inserted between the crossbeam 16 and the flanges 22 of the seat shell 10. This seat support 24 also has two openings corresponding to throughholes 18 and is attached to the crossbeam 16 beneath the seat shell 10 by means of them. The seat support 24 represents a bracing for the seat, which can taper flexibly only until running into the seat support 24 and then forms a bracing for the seat panel. Further loads are not accommodated with a further incline of the seat panel around the crossbeam 16. Rather, they are dealt with by deflecting the back support rearward; the joint serving for this action is not the crossbeam 16, but rather the connecting arc between the seat panel and the back support of the seat shell 10.

The chair shown in FIG. 1, which serves as the basic unit for the chair row, has four separate legs, specifically two front legs 26 and two back legs 28. The front and back legs again consist of aluminum profiles. Their lower ends are capped with plastic sliders 30. At their upper ends the front legs 26 and back legs 28 are offset horizontally and at that place display connection heads 32 whose shape in cross-section matches that of the crossbeam 16. Thus they also display openings that correspond to the throughholes 18 of the crossbeam 16. In this fashion, fastening screws 34, which are screwed into the throughholes 18 of the crossbeam 16, permit the seat shell 10 to be attached to the crossbeam 16, the seat support 24, the back leg 28, and the front leg 26 (in that order). Thus the front legs 26 rest outside of the back legs 28. As can be seen from FIG. 1, the front legs 26 are somewhat more steeply inclined than the back legs 28, which for reasons of stability must provide the chair with greater backward support. The angle between the connection heads 32 and the actual chair leg is accordingly smaller in the case of the front legs 26 than for the back legs 28.

The fastening screws 34 have the above-described task of connecting the various parts. However, their heads are specially designed: they display peripheral screw heads 36 with a circular groove 38, which is positioned approximately in the center of the axial extension of the screw head 36, runs circularly, penetrates radially into the screw head, but is open circumferentially in the outward direction. However, to simultaneously employ this special screw head to manipulate the fastening screws 34, the fastening screws 34 have been given a hexagon socket screw design.

From FIG. 1 it can also be seen that the rear half of the connection head 32 of the front leg 26 is split. This is provided for that case in which the chair is to be furnished with an arm rest 40. The offset provided on the lower end of the arm rest matches the connection head 32 of the front leg 26 and is designed in such a way that a wedge of the arm rest interlocks with the gap in the connection head of the front leg. The wedge also displays an opening which allows the back fastening screw 34 to pass through and connect with the connection head of the front leg 26. The upper and lower sides of the arm rest 40 in the area of the offset 42 are correspondingly elongated above and below the wedge, in order to cover the recesses in the connection head 32 of the front leg 26—as can be seen clearly in the figure.

In order for only one design for the front leg 26 to suffice, even when the chairs are employed without arm rests 40, a matching element 44 is provided. This can be pushed onto the back half of the connection head 32 of the front leg 26 in place of the offset 42 of the arm rest 40 and can be secured with the backmost of the two fastening screws 34.

At its upper end the arm rest 40 displays a cylindrical connecting member 46 which, in the fashion shown, can be screwed into the back part of the seat shell 10 by means of two mounting screws 48 and a separator 50 bridging the width of the back leg 28. It is evident that the angle of incline of the seat back can be adjusted as desired by the appropriate positioning of the center of pressure of the arm rest 40 on the back portion of the seat shell 10, and by means of the arm rest 40. If an arm rest 40 is present, a screw plate 52 is additionally inserted between the ribbings from behind. This screw plate 52 is furnished with two threaded holes so as to provide a secure positioning of the mounting screws 48. However, if the chair is used without an arm rest, the corresponding point on the seat back can be sealed by applying a cover 54.

FIG. 1 also reveals that a open area remains between the two reinforcements 20, into which a seat number sign 56 can be introduced, to remain on the chair permanently.

If the chair is to be used as the final chair in a row, then a sign indicating the row number can also be provided. As can be seen in FIG. 1, the row number sign 58 displays snap-in openings by means of which it can be pressed into the peripheral grooves 38 of the horizontally adjacent screw heads 36 of the fastening screw 34. The row number sign 58 can be removed as simply as it is mounted. Its positioning is nonetheless reliable and permanent.

If no importance is attached to the chair numbering, for example in spaces for seminars or for teaching, this place can used instead to mount e.g. an ashtray 59, which likewise can be simply inserted between the two reinforcements 20.

Figure 2:
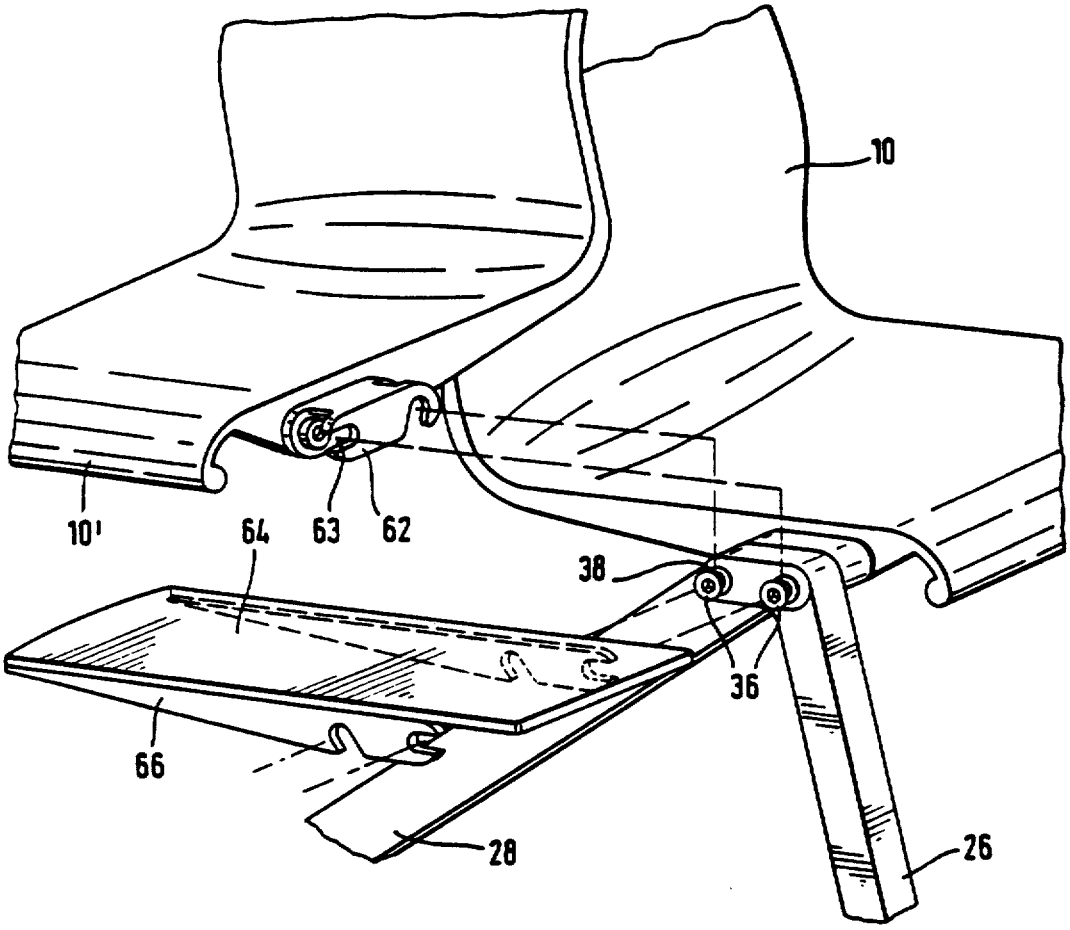
FIG. 2 a section depicting the insertion of a legless seat shell with insert lock between adjacent chairs with legs, or depicting the insertable tray, and FIG. 3 a section depicting the use of the serial connector for connecting two adjacent chairs with legs.

Finally FIG. 1 shows another serial connector 60 on the other side of the seat shell 10. This represents a free individual part, which can be employed as the occasion demands. It is not required when a legless seat shell according to FIG. 2 is inserted between the chairs according to FIG. 1. It then serves to cover the screws projecting on the row end. This is also the reason why, when armrests 40 are not employed, this point can be used to position e.g. a writing panel 61 by means of the backmost fastening screws 34.

As can seen in FIG. 1 the serial connector 60 has two snap-in openings on the side facing the seat shell, the front one of which is open from below and the back one of which is open from behind. The serial connector can thus be easily brought into a position on the chair, namely by pressing the snap-in opening that is open from the back onto the screw head 36 of the backmost of the two fastening screws 34, while swivelling the front end of the serial connector upwards. When the snap-in opening that is open from behind has locked into the peripheral groove 38 of the screw head 36 of the backmost fastening screw 34, the front end of the serial connector 60 is swivelled downwards around this axis and is pressed into the peripheral groove 38 of the screw head 36 of the foremost of the two fastening screws 34 in the same fashion and is thereby mounted to the chair. Naturally the geometry of these two differing snap-in openings can be reversed without basic modification, such that the front snap-in opening of the serial connector is open from the front and the back snap-in opening is open from below. The serial connector embodiment shown in FIG. 1 is preferred, however.

It is to be observed nonetheless that the two snap-in openings, as shown in FIG. 1, which face the seat shell 10 of the chair to which the serial connector 60 is attached only partially extend into the body of the serial connector 60. The other side of the serial connector 60 has a different design, as can been seen in FIG. 3 (see below).

FIG. 2 shows a seat shell 10 with front legs 26 and back legs 28, as well as the screw heads 36 with hexagon socket screws and peripheral groove 38 representing, in the manner described above, the lateral boundary of the chair. However, this only represents the manner in which an end chair—and otherwise every second chair of a row—is formed. Between them are inserted legless seat shells 10' which are furnished on the sides with insert locks 62 produced from metal, preferably sheet steel. The serial connectors, on the other hand, preferably consist of plastic. As clearly shown in FIG. 3, the legless seat shells 10' do not display screw heads 36 on the outer boundary, but rather an insert lock 62. As with the arrangement of the screw heads on the chairs with legs serving as the basic unit, this insert lock 62 is provided on either side—which is the decisive point. The insert locks 62 on the legless seat shell 10' display a snap-in opening 64 open from the front for positioning in the peripheral groove of the foremost of the two fastening screws 34 of the adjacent chair with legs and display a snap-in opening diagonally open from below and also open from the front for positioning in the peripheral groove 38 of the backmost of the two fastening screws 34.

When the adjacent chairs are brought into position it suffices to tip the legless seat shell 10' forward and insert the two front snap-in openings of the two insert locks into the peripheral grooves 38 of the two front fastening screws 34 of the adjacent chairs and to then press the seat shell 10' backward and downward around this rotational axis, until the rear snap-in opening of the insert lock 62 tangential to the rotational axis has also engaged with the corresponding peripheral groove 38 of the backmost of the two fastening screws 34 of the adjacent chairs.

It is evident that this method necessitates considerably less material for the assemblage of seat rows, given an identical number of seats. The weight of the material to be moved during assembly and disassembly of the chair rows is also reduced, as are the space requirements for the stacked chairs. These considerable advantages with respect to cost and manipulation are not paid for by any corresponding disadvantage associated with use.

Depending on the desired end, the system can also be used to insert trays 64 according to the same method between the adjacent chairs in place of the legless seat shells 10'. In place of insert locks, these trays 64 display insert rails 66 on their lower side, which rails are also provided in pairs and are furnished with snap-in openings corresponding to those for the insert locks 62. The trays 64 are positioned in the same fashion as the legless seat shells 10', as described above.

Figure 3:
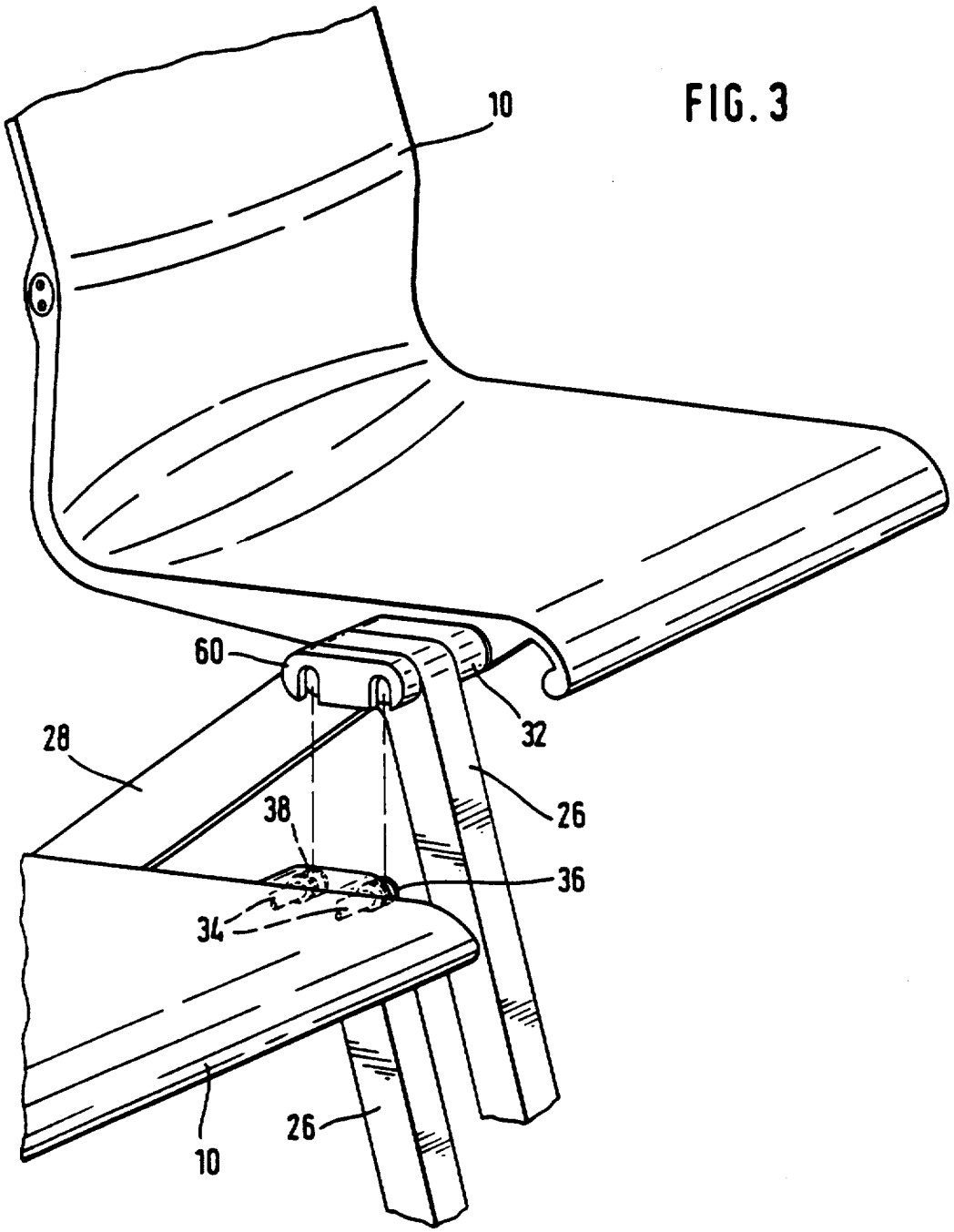

FIG. 3 depicts the serial connector shown only from one side in FIG. 1; here the other side is shown. It can be clearly seen that on this other side both snap-in openings are open from below. The significance of this is as follows:

As described above, the serial connector 60 is secured in fixed but detachable fashion to the right (or left) outer side of the chair and at that place projects forward somewhat. Likewise the screw heads 36 displaying circular grooves 38 of the two fastening screws 34 on the left (or right) side of the adjacent chair in the row project forward somewhat. As indicated by the broken line in FIG. 3, the chair displaying the serial connector 60 can thus be simply positioned from above onto the two screw heads 36 of the adjacent chairs in a row and thus be connected to the adjacent chair in fixed but detachable form. This increases the versatility of the chair structure.

At this point reference is again expressly made to the fact that FIG. 3 depicts a special case, in which all chairs assembled in a row are furnished with four individual legs each. What is essential, however, is that the explained principle of connection permits the number of complete chairs furnished with legs to be reduced to almost 50%, specifically through the use of legless seat shells, as explained above on the basis of FIG. 2. Reference is made to the fact that linkage and insertion is performed wholly without the use of tools.

We claim:

1. Chair structure for the assemblage of chair rows of interlinked chairs, where the lateral outside boundary of a chair is formed by two screw heads placed in succession at a given distance each head having a groove about the periphery adapted to engage with snap-in openings of a serial connector similarly engaged to an adjacent chair, wherein each chair has a seat shell, chair legs and a crossbeam positioned beneath said seat shell and is provided on either side with said two screw heads outwardly projecting with said peripheral groove, said chair being arrangeable in rows by means of an intermediate member which can be inserted between two chairs, the intermediate member having on either side an insert lock with front and rear snap-in openings, said front snap-in opening is open from the front and said rear snap-in opening is open from below, said serial connector having snap-in openings on either side for the screw heads to laterally cover the projecting screw heads and to connect adjacent chairs with legs, the snap-in openings of said serial connector are both open from below on one side and on the other side one snap-in opening is open from below and the other snap-in opening is open from behind.

2. The chair structure as claimed in claim 1, wherein the two screw heads are pat of fastening screw which serve to secure the chair legs to the crossbeam.

3. The chair structure as claimed in claim 2, wherein said chair legs have connection heads on their upper ends, said connection heads having throughholes for the two fastening screws.

4. The chair structure as claimed in claim 2, wherein the fastening screws also hold together the seat shell and the crossbeam.

5. The chair structure as claimed in claim 1, wherein the intermediate member is a legless seat shell.

6. The chair structure as claimed in claim 5, wherein said insert lock is attached with a screw to a legless seat crossbeam positioned beneath a front edge of said legless seat shell.

7. The chair structure as claimed in claim 1, wherein the intermediate member is a tray.

8. The chair structure as claimed in claim 7, wherein the tray displays two insert rails on its lower side, each of which has two snap in openings, the foremost of which is open from the front and backmost of which is open from below.

* * * * *